United States Patent [19]

Schefer

[11] Patent Number: 4,709,866

[45] Date of Patent: Dec. 1, 1987

[54] THREAD GUIDING AND SCREENING ELEMENT FOR USE IN FILAMENT WINDER

[75] Inventor: Kurt Schefer, Winterthur, Switzerland

[73] Assignee: Rieter Machine Works, Ltd., Winterthur, Switzerland

[21] Appl. No.: 2,164

[22] Filed: Jan. 12, 1987

[30] Foreign Application Priority Data

Jan. 22, 1986 [GB] United Kingdom ..... 8601453

[51] Int. Cl.[4] ..... B65H 67/044

[52] U.S. Cl. ..... 242/18 A; 242/18 DD; 242/18 PW

[58] Field of Search ..... 242/18 A, 18 DD, 18 PW, 242/25 A, 56 A

[56] References Cited

U.S. PATENT DOCUMENTS

| | | | |
|---|---|---|---|
| 4,327,872 | 5/1982 | Sachleben, Sr. et al. | 242/18 A |
| 4,598,876 | 7/1986 | Schefer | 242/18 A |
| 4,609,159 | 9/1986 | Flueli | 242/18 A X |
| 4,613,090 | 9/1986 | Sugioka | 242/18 A |

*Primary Examiner*—Stanley N. Gilreath

*Attorney, Agent, or Firm*—Kenyon & Kenyon

[57] ABSTRACT

The winder is provided with a screen which is movable into a screening position over the lower chuck when a changeover to the upper chuck is to be performed. The screen carries a pivotally mounted guide element at the end which is pivotable into a thread guiding position to divert the thread towards the upper chuck as well as into a lowered position out of the path of the thread to screen the package on the lower chuck and particularly a trailing end of a thread from entangling with the thread on the upper chuck.

10 Claims, 5 Drawing Figures

THREAD GUIDING AND SCREENING ELEMENT FOR USE IN FILAMENT WINDER

This invention relates to a thread guiding and screening element for use in a filament winder.

As is known, various tyoes of winders have been known for the winding of thread, particularly synthetic plastics filaments, into packages on one or more chucks. For example, U.S. patent application Ser. No. 810,679, filed Dec. 18, 1985 describes a winder having a pair of chucks which can be brought in succession into winding association with a contact member, such as a friction roller, such that winding of a thread delivered to the winder can be carried out substantially continuously. With this winder, the completion of winding of one thread package on one chuck is succeeded by a changeover of winding to the second chuck. This winder operates on the so-called print system in which a thread is laid first upon the contact member and is then delivered therefrom to a package forming on one of the chucks. The contact member may be a friction drive roll which is adapted to transmit drive to a chuck/package in contact therewith or may be a roller which contacts a chuck/package without transmitting power.

As described in U.S. patent application Ser. No. 810,679, one of the chucks has a rest position above the contact member while the other chuck has a rest position below that member. This application is hereinafter referred to as the "basic application", and the disclosure of the basic application is hereby incorporated in the present specification by reference.

A modification to the machine geometry described in the basic application is shown in U.S. Pat. No. 4,609,159. A preferred form of mechanism for moving the thread axially of a chuck into a thread catching device thereon is described in U.S. patent application Ser. No. 723,981 filed Apr. 16, 1985. A preferred form of enclosure for winders of the relevant type is disclosed in U.S. patent application Ser. No. 879,292 filed June 22, 1986. The disclosure of each of these prior applications is incorporated in the present specification by reference.

U.S. Pat. No. 4,598,876 describes a screening means for screening a completed package from a winding zone of a machine in which winding of a newly-forming package is being carried out. That patent is referred to hereinafter as the "related application" and the full disclosure of this related application is hereby incoporated in the present specification by refernece. In addition, certain elements described and illustrated in the related application are shown in the drawings of this application and will be referred to briefly in the present description.

Finally, preferred forms of the geometry disclosed in the basic application are defined in a copending U.S. patent application Ser. No. 941,418 filed on Dec. 15, 1986. That U.S. patent application is referred to hereinafter as the "copending application". The present invention relates to modifications in certain elements disclosed in the copending application, the full disclosure of which is also incorporated in the present specification by reference.

In some instances, when a fresh winding operation is commenced on the upper chuck of a winder of the above type, a package on the lower chuck is still rotating at very high speed prior to braking to a stop. During this braking stage, the thread tail can be hurled outwards from the periphery of the package by centrifugal force and can entangle with the upper chuck or with the newly forming package thereon. If the tail is long enough, the tail may also entangle with the thread on the friction roll. A similar thread tail on the upper chuck may also be created which can entangle in a similar fashion with a package on the lower chuck or with the thread on the friction roll.

Accordingly, it is an object of the invention to prevent the entanglement of a tail of thread on a rotating outgoing thread package with the thread of a newly wound package on a freshly supplied chuck in a thread winder.

It is another object of the invention to avoid entanglements of a trailing thread with a thread being wound on another chuck in a winder.

It is another object of the invention to provide a relatively simple construction for preventing thread entanglements in a thread winder.

Briefly, the invention provides a winder for thread which is comprised of a contact member rotatable about a longitudinal axis thereof for receiving and delivering a travelling thread, a first chuck which is movable between a first rest position above the contact member and a winding position adjacent the contact member to receive and wind a thread into a thread package thereon and a second chuck which is movable between a second rest position below the contact member and a winding position adjacent the contact member to receive and wind a thread into a package thereon. In accordance with the invention, a screen is provided which has an operative position between the contact member and the second chuck during movement of the second chuck to the second rest position in order to screen the package on this chuck from the contact member as well as from a package forming on the first chuck. Further, the screen includes a guide element for diverting a thread extending between the contact member and the package on the second chuck towards the first chuck. The guide element is movable in the operative position of the screen so as to move via suitable means between a first position to divert a thread extending between the contact member and the second chuck to function as a guide and a second position spaced from the thread to perform a screening function.

The screen is also movable between the operative position and a retracted position located below the plane of movement of the second chuck between the rest position and winding position thereof. When in the retracted position, the screen does not interfere with any moving parts of the winder. This retracted position may be located beneath the contact member and suitable means are provided for moving the screen between the operative and the retracted position.

These and other objects and advantages of the invention will become more apparent from the following detailed description taken in conjunction with the accompanying drawings wherein:

FIG. 1 diagrammatically illustrates the "geometry" of changeover operations in a winder in accordance with the invention;

Figure 1:
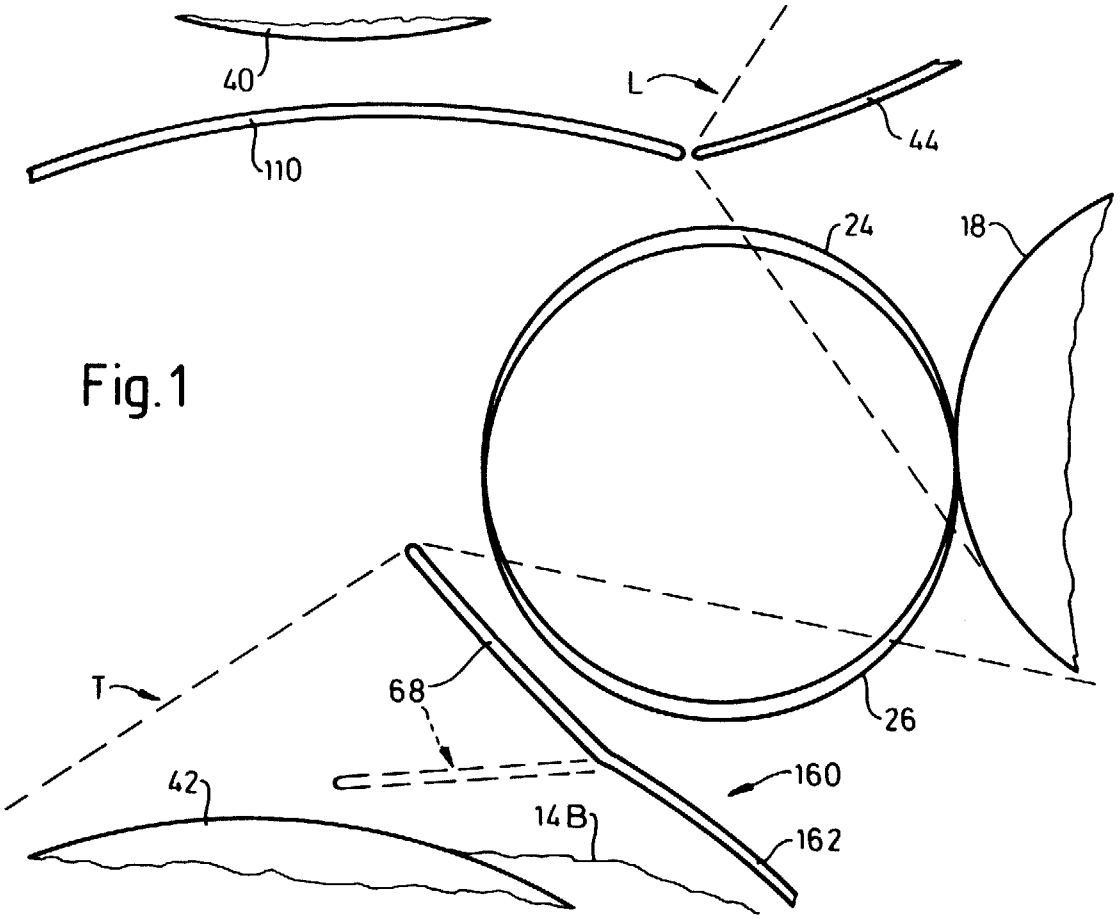
Figure 4:
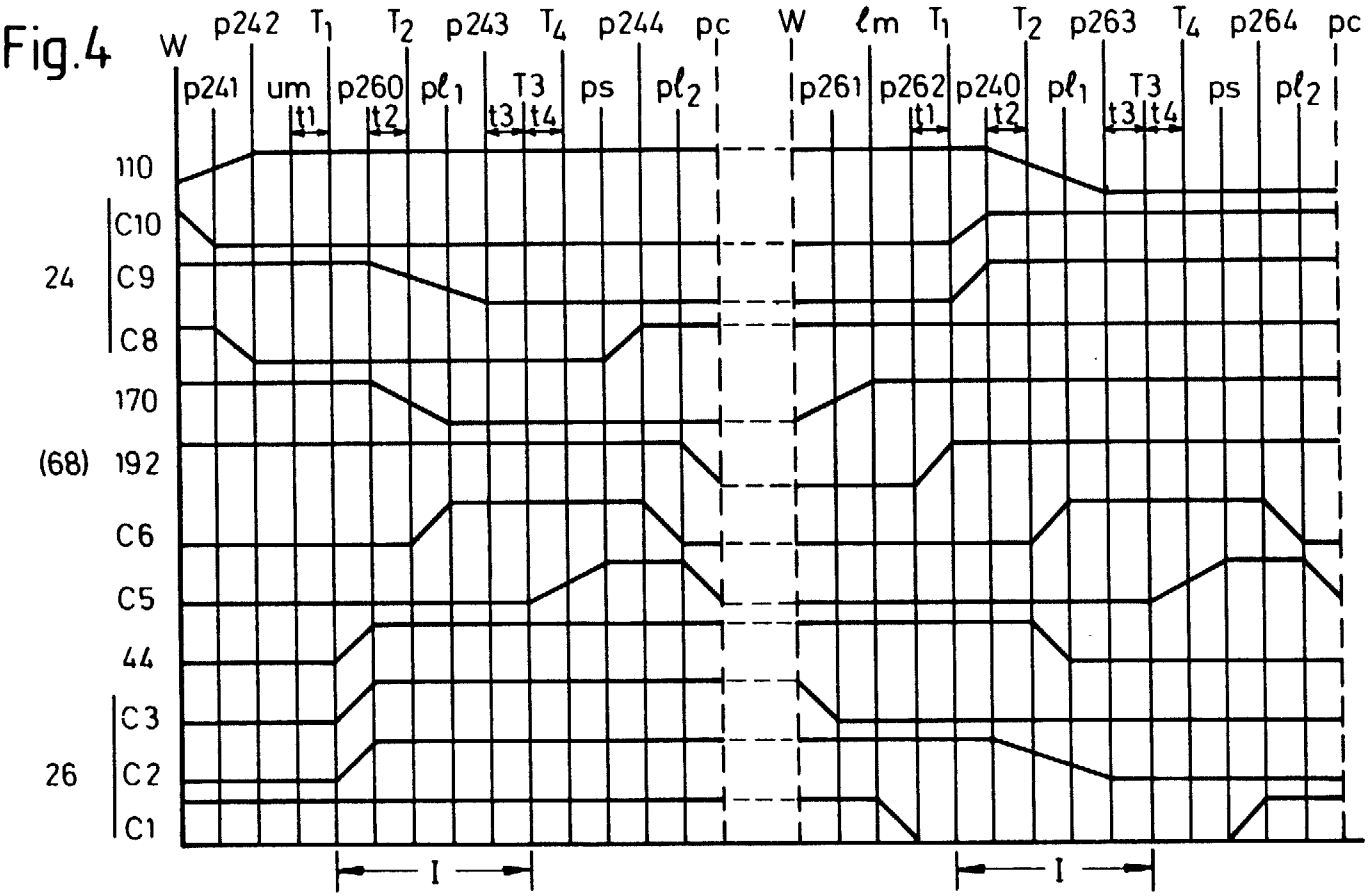
FIG. 4 illustrates a sequence diagram showing the sequence of movements of elements referred to in the description of FIGS. 1 to 3.

The changeover "geometry" of the winder illustrated in FIG. 1 is essentially similar to that illustrated in FIG. 4 of the copending application. In order to enable ready comparison of the two applications, the reference numerals used to indicate elements in the copending application will be used to indicate the same elements in the present application. The overall arrangement of the winder has been described in the copending application (taken together with the disclosure in the basic application), and will not be repeated here.

Referring to FIG. 1, the winder includes a contact member in the form of a friction drive roll 18 which is rotatable about a longitudinal roll axis (not shown). The winder operates in accordance with the so-called "print friction" system, in which a thread delivered to the winder travels around the friction drive roll 18 before being transferred to one or other of a pair of chucks 24, 26 to be wound into a package thereon.

FIG. 1 indicates one chuck 24 of the pair of chucks in a winding position of first contact with the drive roll 18. As in the copending application, the term "chuck" is used here to refer briefly to the chuck structure itself together with one or more bobbin tubes carried by the chuck during a winding operation, and removable therefrom with the package(s) after completion of that operation.

Each thread package is formed upon a respective bobbin tube. The circle 24 shown in FIG. 1 therefore actually represents the outer periphery of a bobbin tube on the chuck structure. The circle 26 shown in FIG. 1 represents a lower chuck (chuck structure plus bobbin tube) in a winding position of first contact with the friction roll 18.

Each chuck 24, 26 has a non-illustrated rest position, the rest position for chuck 24 being above the level of the friction roll 18 and the rest position for the chuck 26 being below the level of the friction roll 18. While one chuck is involved in a winding operation, in driving contact with friction roll 18, the other chuck is maintained in its rest position. When a full package of desired dimensions has been built-up on a chuck in a winding position, a "changeover" is effected in accordance with which the chuck bearing the full package is returned to its rest position, and the other chuck is moved into driving relationship with the friction roll 18. Reference numeral 40 in FIG. 1 indicates the lowermost portion of a full thread package carried by chuck 24 when in its rest position, and reference numeral 42 indicates the uppermost portion of a full thread package carried by chuck 26 when in its rest position.

In the initial portion of a changeover operation, a length of thread is created between the friction roll 18 and the "outgoing" package (40 or 42). The thread length created during changeover for a package 40 on upper chuck 24 to an "incoming" lower chuck 26 is indicated in dotted lines at L. The length of thread created during changeover from an outgoing full package 42 on chuck 26 to an incoming upper chuck 24 is indicated at T, also in dotted lines. As described in the copending patent application, diverter guide elements 44, 68 are provided to divert the thread path for the thread lengths L, T to enable interception of those thread lengths by an incoming chuck 26, 24 respectively. In FIG. 1, the thread lengths are illustrated in their positions prior to interception by the relevant incoming chuck. It will be apparent from the preceding description that the elements shown in FIG. 1 are not all present simultaneously in the illustrated dispositions; the sequence of operation of these elements will be described later with reference to FIG. 4.

The function and operation of the guide elements 44, 68 as guiding elements is fully described in the copending application, and will not be dealt with again here. U.S. Pat. No. 4,598,876 describes the use of guide 44 in conjunction with an additional element indicated at 110 in FIG. 1 to form a screen between a full package 40 on a chuck 24 in its rest position and a package building on chuck 26 in the winding position. Details of this "upper screen" will not be repeated here, although the sequence of operation of the elements 44, 110 will be described with reference to FIG. 4.

As illustrated, the lower guide element 68 is incorporated in a screen 160. While the upper chuck 24 is in the winding position, a package 42 carried by the lower chuck 26 (in its rest position) is screened from the upper chuck 24 (together with a newly-forming package thereon) and from the friction roll 18 by the screen 160.

The screen 160 is maintained in an operative position throughout a winding operation of the upper chuck 24. However, the guide element 68 cannot be maintained in the position indicated in full lines in FIG. 1, i.e. in its changeover position, because very soon after completion of the changeover operation, the guide element would interfere with the package forming on the uoper chuck 24. Accordingly, the element 68 is pivotally mounted on a screen element 162 of the screen 160 and can be pivoted to the dotted line position after changeover.

The screen 160, as a whole, must also be movable between its extended operative position, illustrated in FIG. 1 and a retracted position (FIG. 2), in which the screen will not interfere with movement of the lower chuck 26 between its rest and winding positions.

Figure 2:
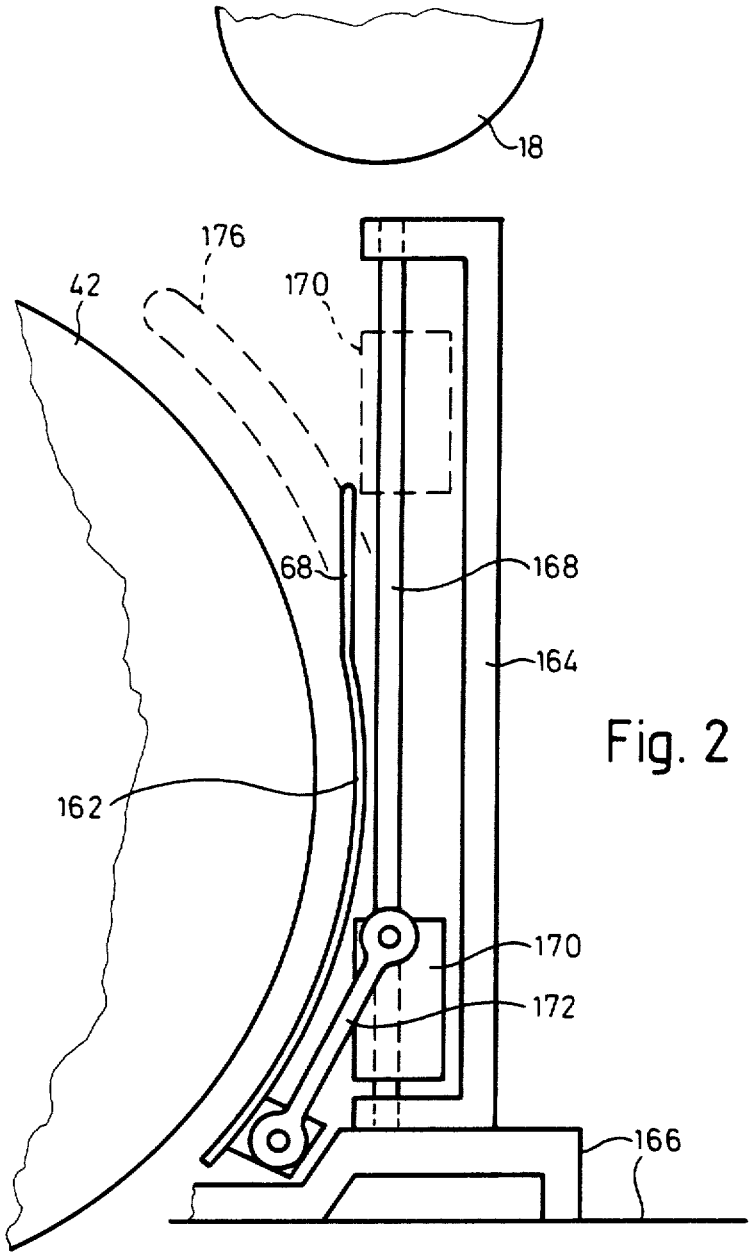
FIG. 2 illustrates a front elevation of another portion of the winder shown in FIG. 1.

FIG. 2 illustrates a portion of the winder below the friction roll 18 (indicated at the upper edge of the Fig.) and to the right of the rest position of the lower chuck 26 as viewed from the front. The right hand edge portion of a full package 42 carried by chuck 26 in its rest position is also indicated. As previously mentioned, the lower screen 160 (made up of the elements 162 and 68) is illustrated in its retracted position and is then adjacent to but spaced from the lower, right-hand portion of the package 42 in the rest (or doffing) position. Guide element 68 is pivoted to its changeover position, that is the guide element 68 is disposed relative to screen element 162 in the angular disposition illustrated in full lines in FIG. 1. With the screen 160 in this condition, a chuck 26 bearing a full package 42 can be moved back from the winding position into the rest position without interference between the package and the screen 160.

A means is porvided for moving the screen 160 beteen the operative position (FIG. 1) and the retracted position (FIG. 2) located below the plane of movement of the lower chuck 26. This means includes a support stand 164 mounted on the frame, part of which is indicated at 166, to support a vertically disposed guide rod 168. In addition, a slider 170 is movable up and down along the guide rod 168 and is connected to the lower edge of the screen element 162 by a drag link 172 pivotally connected to the slider 170 and the screen element 162. The slider 170 is disoosed in the position illustrated in full lines in FIG. 2 when the screen 160 is retracted, and is moved upwardly to the position illustrated in dotted lines when the screen 160 is moved to an extneded operative position. The movement of the slider 170 on the rod 168 can be effected in any suitable manner, for example a piston and cylinder unit (not shown) can be used, or the slider could be connected to one link of a chain drive (also not shown) with the link circulating on an endless path. As will now be described with reference to FIG. 3, the periphery of the package 42 during movement from the retracted to the extended position.

Figure 3:
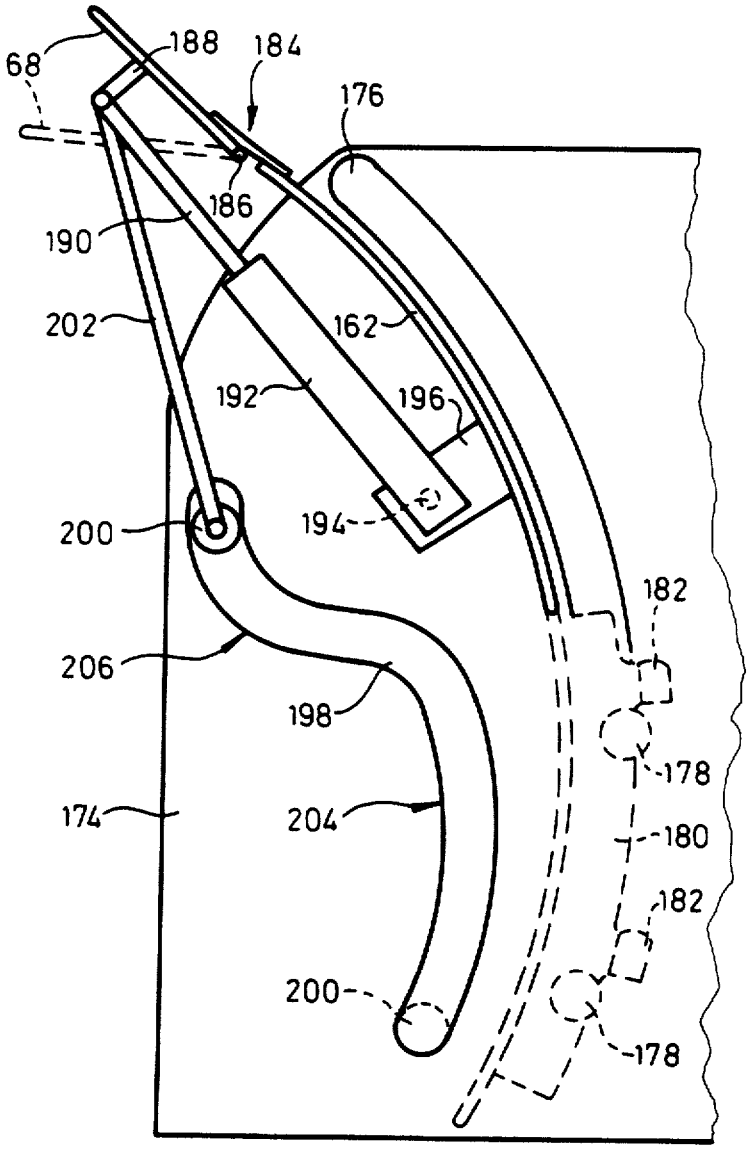
FIG. 3 illustrates a sectioned elevation of the winder of FIG. 1 viewed from the front and omitting certain parts in order to make other parts clearly visible.

The screen element 162 and guide element 68 each extend over the full operating length of the friction roll 18 and chucks 24, 26, that is along the full length on which packages may be built up in use. However, the elements 162, 68 also extend slightly beyond the operating length at each end thereof. Adjacent each end of the screen 160 is a support and guide plate, one such plate being indicated at 174 in FIG. 3. The plate 14 is disposed vertically and at right angles to the axis of the foll 18 and chucks 24,25. Each plate 174 has a groove 176 in the surface facing the screen 160; the disposition of the upper part of this groove is indicated also in dotted lined in FIG. 2. At each end, on its surface facing away from package 42 the screen element 162 carries a bracket 180. The dotted line position of FIG. 3 shows the bracket 180 when the screen 160 is in the retracted position. Each support bracket 180 carries a pair of wheels 178 which extend therefrom into the groove 176, which therefore provides a curved guide track directing movement of the backet 180, and hence the screen element 162, as the slider 170 is moved upwardly along rod 168 (FIG. 2). Each bracket 180 also carries an additional pair of wheels 182 which engage the surface of a plate 174 beside the groove 176. The two pairs of wheels 178, 182, one at each end of the screen 160, locate the screen 160 against movement longitudinally of the axis of the roll 18.

Referring to FIG. 3, a pivot point 182 connects the screen element 162 and guide element 68. As illustrated, this joint 184 comprises a hinge, such that element 68 is rotatable about a pin 186 extending parallel to the upper edge of element 162 and to the axis of roll 18. A strap 188 is secured to the underside of element 68, that is, the side facing away from roll 18. A connecting rod 190 of a piston and cylinder unit, the cylinder of which is indicated at 192, is pivotally connected to strap 188. Cylinder 192 is pivotally secured at 194 to a bracket 196 which is mounted on screen element 162. The piston and cylinder unit is double acting.

When cylinder 192 is pressurized to move rod 190 to its extended position (as illustrated), this tends to urge element 68 into its changeover disposition as illustrated in full lines. When cylinder 192 is pressurized in the opposite sense, tending to withdraw rod 190 into the cylinder, element 68 is pivoted into the screening disposition, indicated in dotted lines in FIGS. 1 and 3.

When screen 160 is first moved away from the retracted position shown in FIG. 2, element 68 is in its changeover disposition relative to element 162. However, it is desirable to adjust these relative dispositions during movement of the screen to the extended position, to avoid the possibility of interference between element 68 and a chuck 24 which may already have arrived in its winding position shown in FIG. 1. As seen in FIG. 3, this can be achieved by means of an additional groove 198 in plate 174, together with a follower 200 movable in the groove 198 and a link 202 pivotally attached to follower 200 and to strap 188. When the screen is in its retracted position, follower 200 is in the position indicated at dotted lines at the lower end of groove 198. As the screen is moved towards its extended position, follower 200 first moves along the groove portion 204 which follows a curve corresponding to that of groove 176 so that there is no initial change in the disposition of element 68 relative to element 162. However, as the screen approaches a position in which interference might occur, groove 198 is provided with a bend 206 such that follower 200 is drawn away from bracket 180.

This causes pivoting of element 68 about pin 186 into (or at least towards) its screening disposition. When the screen has moved past a position in which interference can occur, groove 198 bends back towards groove 176 so that the follower permits cylinder 192 to return element 68 to the required changeover position. The system supplying pressure fluid to cylinder 192 (not shown) must be such that it enables relatively easy venting of the cylinder to permit the required pivotal movement of element 68 against the resilient bias provided by the pressure in the cylinder. This resilient bias automatically returns element 68 to the changeover position as soon as such movement is permitted by follower 200 and groove 198.

The sequence of operation of elements referred to in the preceding description will now be dealt with by reference to FIG. 4. This Figure represents a modified version of the sequence diagram provided in FIG. 6 of the copending application. Since the basic movements involved have already been described in the copending application, they will be referred to again only briefly here, and attention will be concentrated upon the differences between the two diagrams. The reference symbols used for description of FIG. 6 in the copending application will therefore be used again to indicate similar parts represented in FIG. 4 of the present application.

In FIG. 4, time is represented on the horizontal axis. The Figure shows a series of traces representing the conditions of various elements which will be referred to below. In each trace, a horizontal line represents continuation of a given condition, whereas a line inclined to the horizontal represents a change of condition. Each vertical line on the Figure represents the start/finish of one step in a sequence; the diagram is not intended to represent precise timing of the various steps, but only their sequence, so that equal distances along the horizontal axis do not necessarily represent equal time intervals.

The sequence of steps illustrated between the left-hand vertical line and the first vertical dotted line represent a changeover from a winding operation on the lower chuck to winding on the upper chuck. The steps illustrated between the second and third vertical dotted lines represent changeover from a winding operation on the upper chuck to winding on the lower chuck. As indicated by the horizontal dotted lines, the conditions taken up by the various elements at the completion of a changeover are maintained throughout the succeeding winding operation until the initiation of the next changeover. Initiation of a changeover is indicated by the letter W on the vertical axis and on the second vertical dotted line.

The complete changeover operation has been described in the copending application and the details will not be repeated here. On the vertical axis, the references C1, C2 and C3 identify traces representing the conditions of piston and cylinder units causing movement of the lower chuck 26; unit C1 causes movement of the chuck in its own mounting axially of its own length (the purpose of this movement is described in detail in the basic application); unit C3 causes movement of the chuck from its rest position to its acceleration position; unit C2 causes movement of the chuck from the acceleration position into a winding position, and maintains a desired contact pressure between a package on the chuck and the friction roll 18 during a winding operation. The references C8, C9 and C10 represent the corresponding units for the upper chuck 24.

Reference C5 represents a piston and cylinder unit which operates a guide to move the thread axially of a chuck in the winding position during a changeover operation; the arrangement may be in accordance with that illustrated in U.S. Pat. No. 3,920,193 or, preferably, in accordance with U.S. patent application No. 723,981. Reference C6 represents a piston and cylinder unit which causes a pusher to lift the thread out of a traverse mechanism (for example that illustrated at 22 in the copending application) so that the thread adopts a known position axially of the chuck ready for succeeding stages of the changeover operation.

The other reference numerals in FIG. 4 correspond to those used in the description of FIGS. 1 to 3. Thus, trace 44 represents the condition of guide element 44 shown in FIG. 1, trace 192 represents the condition of cylinder 192 shown in FIG. 3 (and thus the angular disposition of guide element 68 relative to screen element 162), trace 170 represents the condition of slider 170 (i.e. its position along guide rod 168) and trace 110 represents the condition of screening element 110 shown in FIG. 1.

Each changeover operation is controlled by a combination of position sensors and timing elements; these are represented by the references associated with respective vertical lines at the top edge of FIG. 4. Position sensors are represented by the prefix (p) and timers by the prefix (T). Position sensors p241, p261 register the presence of the respective chuck (24, 26) in the acceleration position. Position sensors p242, p262 register the retraction of the respective chuck (24, 26) into its withdrawn position relative to a non-illustrated head stock (for the purpose described in the basic application). Sensors p260, p240 register the return of the respective chuck (26, 24) to the rest position. Sensor pl1 registers operation of unit C6 to lift the thread out of its traverse mechanism, and sensor pl2 registers the return of unit C6 to its inoperative condition. Sensors p243, p263 register the presence of the respective chuck (24, 26) in an "approach" position close to (but not yet in contact with) friction roll 18. Sensor ps registers completion of the axial shift of the thread caused by unit C5 (this indicates that catching of the thread by the incoming chuck has been completed). Sensors p244, p264 register the return of the respective chuck (24, 26) to its extended position relative to the head stock (i.e. its position for a normal winding operation). Reference pc represents a number of sensors which register conditions representing the completion of a changeover operation, with the various elements prepared for the next such changeover. All of these p-sensors are also referred to in the copending application.

Timer T1 defines an interval within which each chuck is accelerated to a desired rotation or speed in preparation for take-over of the thread. Timer T2 defines a predetermined time delay, following which the thread is lifted from the traverse mechanism; this delay (and hence the continuation of the normal traverse movement) is made as long as possible. Timer T3 defines a predetermined brief time interval following sensing of the approach position (243 for chuck 24, 263 for chuck 26); during this brief interval, interception of the thread by the incoming chuck occurs, and axial shift of a thread is initiated at the expiry of this interval. Timer T4 divides operation of the axial shift into two stages, in accordance with U.S. patent application No. 723,981. All of these timers are also referred in the copending application.

Two sensors have been represented in FIG. 4 additionally to those represented in FIG. 6 of the copending application, namely a monitor um responsive to the condition of the upper screening element 110 (FIG. 1) and a monitor lm responsive to the condition of the lower screening element 162 (FIGS. 1 and 3). Considering first the changeover from a winding operation on the lower chuck 26 to the upper chuck 24, the first step (as in the copending application) is movement of chuck 24 into its acceleration position; at the same time, however, screen element 110 (FIG. 1) is withdrawn from its operative to its (non-illustrated) inoperative position, thereby leaving the way free for subsequent movement of chuck 24 into winding association with friction roll 18. Withdrawal of screen 110 must be registered by monitor um before the acceleration interval t1 commences. At the start of this changeover, upper guide 44 is also in its guiding/screening position as illustrated in FIG. 1. This guide must also be withdrawn to its non-illustrated, inoperative position before chuck 24 is moved into winding association with friction roll 18. By way of example, withdrawal of guide 44 has been illustrated as occurring simultaneously with return of chuck 26 to its rest position; however, withdrawal of guide 44 could be carried out earlier in the changeover.

At the start of the changeover, the screen assembly 160 is in its retracted position (FIG. 2) with slider 170 at the bottom end of guide rod 168. The screen assembly is maihtained in this condition until sensor p260 registers return of chuck 26 to its rest position. Slider 170 is then raised along rod 168 to move screen assembly 160 into the operative condition as described with reference to FIGS. 1 to 3. This step is assumed to be complete by the time the thread lifter (represented by unit C6) has lifted the thread out of the traverse mechanism; if required, a separate sensor could be provided to register the presence of screen assembly 160 in its operative position. After reaching the operative position, the screen 160 stays there throughout the remainder of the changeover and the succeeding winding operation.

At the commencement of the changeover, cylinder 192 is pressurized to extend rod 190 (FIG. 3) and thereby force guide element 68 into the thread guiding disposition relative to screen 162 (as illustrated in FIG. 2). This condition of cylinder 192 is maintained throughout the changeover operation although, as described with reference to FIG. 3, the disposition of the guide element 68 relative to the screen element 162 is changed during movement of the screen 160 into the operative position due to the action of the follower 200 and guide groove 198. When catching of the thread length T (FIG. 1 has been completed, however, the condition of cylinder 192 is changed in order to move element 68 from the full-line position (thread guiding position) illustrated in FIG. 1 to the dotted-line position (screening position). This is illustrated as the final step in changeover from the lower to the upper chuck, but in fact be carried out earlier in the sequnce, namely at any time after position sensor ps has registered completion of axial shifting of the thread under the action of unit C5.

After moving into the screening condition, the guide element 68 is maintained therein throughout the subsequent winding operation. The effect of the screen 160 can be seen from FIG. 1. Severing of the thread length T porduces a thread tail 14B projecting from the periphery of the outgoing package 42. When a new winding operation is commenced on upper chuck 24, package 42 is still rotating at very high speed; the subsequent braking of chuck 26 occupies a certain time interval after commencement of winding of the thread on chuck 24. During this braking stage, the thread tail 14B is hurled outwards from the periphery of package 42 by centrifugal force, and can entangle with the chuck 24 or the newly forming package thereon or (if the tail is long enough) with thread on the friction roll 18. The screen 160 prevents such interference. There may be a similar thread tail on chuck 24, and this is also separated from the outgoing package by the screen 160.

It will be noted in particular that the screen 160 is in the operative position before the final phase of the changeover is initiated i.e. before transfer of the thread to the incoming chuck is carried out. Thus, the screening assembly is already fully efffective at the time of formation of the end 14B (FIG. 1) by severing during the actual transfer step.

In the changeover from the upper to the lower chuck, downward movemeht of the slider 170 on the guide rod 168 is commenced simultaneously with movement of the lower chuck 26 into an acceleration position. The guide element 68 is maintained in the screening condition during this retraction of the screen 160. Monitor lm must register the return of the screen 160 to the position illustrated in FIG. 2 before commencement of acceleration of the incoming chuck 26. The guide element 68 can be returned to the thread guiding disposition relative to scree element 162 (as illustrated in FIG. 2) at any stage after the completion of the retraction operation. Screen element 110 can then be moved into its operative position illustrated in FIG. 1, as soon as position sensor p240 registers the return of chuck 24 to its rest position. This upper screen element reaches the operative position before commencement of axial shifting of the thread into the catching device on the lower chuck 26, then in the winding position.

Also, during changeover from the upper to the lower chuck, the return of element 44 to the screening/guiding position takes place during movement of the chuck 26 into the winding position as described in the co-pending application. All other aspects of each changeover are as described in the copending application. In particular, it will be noted that the present invention does not require any changes in the interval I, indicated on the horizontal axis, and also does not require changes in the final phase of the changeover following completion of interval I.

Figure 5:
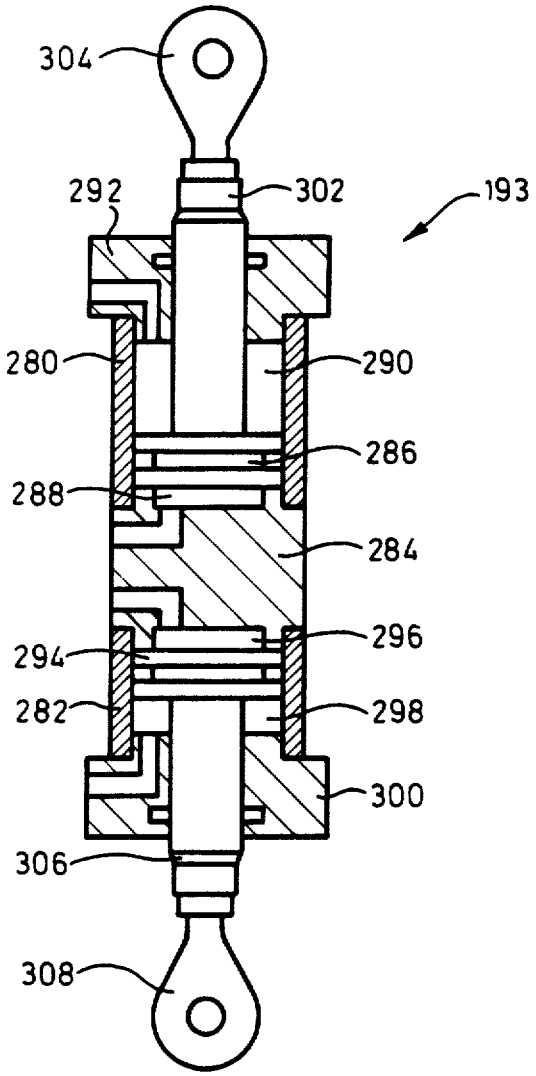
FIG. 5 illustrates a sectional view of a piston and cylinder unit for moving a guide element of a screen in accordance with the invention.

FIG. 5 illustrates a modification enabling elimination of the groove 204, 206, follower 200 and rod 202. In the embodiment according to FIG. 5, a modified double acting piston and cylinder assembly 193 is provided between the screen element 162 and guide element 68 as a means for moving the guide element 68 between the thread guiding position and the screening position. This assembly 193 is capable of being operated selectively to position the guide element 68 in the desired disposition relative to the screen element 162.

The assembly 193 comprises first and second cylinder sections 280, 282 respectively joined by an intermediate block 284. Section 280 is divided by a piston 286 into a first chamber 288 adjacent block 284 and a second chamber 290 adjacent an end plate 292. Similarly, section 282 is divided by a piston 294 into a first chamber 296 adjacent block 284 and a second chamber 298 adjacent an end plate 300.

A connecting rod 302 extends from piston 286 through end plate 292. Rod 302 has a link 304 at a free end, to be connected by a pivot joint (not shown) to either strap 188 or bracket 196 in FIG. 3. A similar rod 306, with a link 308, extends from piston 294 through end plate 300. Link 308 can be pivotally joined to the connector (strap 188 or bracket 196) not joined to the link 304.

Cylinder section 280 and piston 286 thus form a first piston and cylinder unit, and cylinder section 294 and piston 294 a second such unit. Each unit is double-acting with suitable associated pressurising and vent openings (not specifically indicated) in its associated end plate and in the intermediate block 284. The second unit (lower as viewed in FIG. 5) has a shorter stroke than the first (upper) unit, but the stroke length can be selected in dependence upon the details of the machine geometry and the required function as described immediately below.

In FIG. 5, the assembly is shown in its fully retracted condition—both pistons 286, 294 engage the intermediate block 284. Comparison of FIG. 5 with FIG. 3 will indicate that this condition of the assembly is appropriate for holding guide element 68 in the screening (FIG. 3—dotted line) position relative to element 162. On the other hand, a fully extended assembly—with the pistons 286, 294 engaging their respective end plates 292, 300—is appropriate for holding guide element 68 in the guiding (FIG. 3—full line) position relative to element 162.

As before, the guide element 68 is held in its guiding disposition relative to element 162 (assembly 193 fully extended) while the screen 160 is in the retracted position. Since it is assumed unnecessary to move the flap-like guide element 68 fully into the screening disposition merely to avoid a collision with chuck 24 as the screen 160 moves to the operative position, either of the piston and cylinder units could be operated to shift the guide element 68 temporarily to an intermediate disposition as the element 68 approaches the region of "collision-risk" and then to return the element 68 to the guiding disposition i.e. one only of the rods 302, 306 is temporarily retracted and then returned to the fully extended position.

The pressure fluid medium required to operate the piston and cylinder arrangements of FIGS. 3 and 5 can be supplied via suitable flexible leads, the end portions of which can move with the aseembly.

In a further modification (not illustrated) the piston and cylinder arrangements can be replaced by e.g. a worm gear extending between bracket 196 and strap 188 and rotatable by a stepping motor. A nut can be arranged to move along the worm gear as it rotates, reciprocation of the nut being arranged to operate the guide element in the same way as extension/retraction of the illustrated piston and cylinder units. Other operating arrangements can be developed as required by the circumstances.

Further, the complete screen 160 could be moved from the thread guiding disposition into a screening disposition following completion of the guiding step. It is, however, preferred to divide the screen into one element which has a purely screening function (element 162) and a second element (68), adjustable relative to the first, which has both a screening and a guiding function. The mechanisms shown in the Figures are in no way limiting on the invention. Alternative mechanisms to define the required movements can be designed as required. The sequence of operations shown in FIG. 4 can be adapted to the required circumstances.

Screen element 162 and guide element 68 can be formed of sheet material, preferably metal. The sheets are preferably continuous but this is not essential provided a thread end 14B cannot pass through any openings in the sheets.

As described in the copending application, the invention is not limited to friction roll drives but can be applied equally well to spindle driven machines. A contact roll will however still be provided to lay thread into the package, and possibly to provide a freedback signal for control of the spindle drive. Further, as described in the copending application, the thread guiding element (in this case, element 68) may be axially movable to assist in moving the thread axially of the chuck to carry the thread into a catching/severing structure on the chuck.

What is claimed is:

1. A winder for thread comprising a contact member rotatable about a longitudinal axis thereof for receiving and delivering a travelling thread;

a first chuck movable between a first rest position above said contact member and a winding position adjacent said contact member to receive and wind a thread into a thread package thereon;

a second chuck movable between a second rest position below said contact member and a winding position adjacent said contact member to receive and wind a thread into a thread package thereon; and a screen having an operative position between said contact member and said second chuck during movement of said second chuck to said second rest position to screen a package on said second chuck from said contact member and a package forming on said first chuck, said screen including a guide element to divert a thread extending between said contact member and a package on said second chuck towards said first chuck in said operative position.

2. A winder as set forth in claim 1 wherein said guide element is movable in said operative position of said screen between a first position to divert a thread extending between said contact member and said second chuck and a second position spaced from the thread.

3. A winder as set forth in claim 2 wherein said guide element is pivotally mounted within said screen.

4. A winder as set forth in claim 1 wherein said screen is movable between said operative position and a retracted position located below the plane of movement of said second chuck between said rest position and said winding position thereof.

5. A winder as set forth in claim 4 wherein said retracted position is disposed beneath said contact member.

6. A winder as set forth in claim 1 which further comprises means for moving said guide element in said operative position between a first position to divert a thread extending between said contact member and said second chuck and a second position spaced from the thread.

7. A winder as set forth in claim 6 wherein said means includes a double acting piston and cylinder assembly connected between said guide element and a remainder of said screen

8. A winder as set forth in claim 6 which further comprises means for moving said screen between said operative position and a retracted position located below the plane of movement of said second chuck between said rest position and said winding position thereof.

9. A winder for thread comprising a rotatable contact member for receiving and delivering a travelling thread;

a first chuck movable between a first rest position above said contact member and a winding position adjacent said contact member to receive and wind a thread into a thread package thereon;

a second chuck movable between a second rest position below said contact member and a winding position adjacent said contact member to receive and wind a thread into a thread package thereon; and a screen movable into an operative position between said contact member and said second chuck during movement of said second chuck to said second rest position to screen a package on said second chuck from said contact member and a package forming on said first chuck, said screen including a pivotally mounted guide element for pivoting between a first position to divert a thread extending between said contact member and said second chuck towards said first chuck and a second position spaced from the thread in said operative position.

10. A winder as set forth in claim 9 wherein said screen is movable between said operative position and a retracted position located below the plane of movement of said second chuck between said rest position and said winding position thereof.

* * * * *

UNITED STATES PATENT AND TRADEMARK OFFICE

CERTIFICATE OF CORRECTION

PATENT NO. : 4,709,866

DATED : December 1, 1987

INVENTOR(S) : kurt schefer

It is certified that error appears in the above-identified patent and that said Letters Patent is hereby corrected as shown below:

Column 1, line 7 "tyoes" should be -types-
Column 1, line 50 "refernece" should be -reference-
Column 4, line 32 "uoper" should be -upper-
Column 4, line 60 "teen" should be -tween-
Column 5, lien 1 "disoosed" should be -disposed-
Column 5, line 5 "extneded" should be -extended-
Column 5, line 22 "foll" should be -roll-
Column 5, line 26 "lined" should be -lines-
Column 8, line 15 "referred in" should be -referred to in-
Column 8, line 45 "maihtained" should be -maintained-
Column 9, line 6 "fact be" should be -fact may be-
Column 9, line 14 "porduces" should be -produces-
Column 9, line 32 "effective' should be -effective-
Column 9, line 36 "movemeht" should be -movement-
Column 9, line 45 "scree" should be -screen-

Signed and Sealed this

Seventh Day of June, 1988

*Attest:*

*Attesting Officer*

DONALD J. QUIGG

*Commissioner of Patents and Trademarks*